US007329137B2

(12) United States Patent
Martin et al.

(10) Patent No.: US 7,329,137 B2
(45) Date of Patent: Feb. 12, 2008

(54) MODULAR PLUG WITH SLIDER LATCH

(75) Inventors: Ralph Sykes Martin, Mount Airy, NC (US); Christine A. Dooley, Lewisville, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/243,854

(22) Filed: Oct. 5, 2005

(65) Prior Publication Data

US 2007/0077806 A1 Apr. 5, 2007

(51) Int. Cl.
*H01R 13/625* (2006.01)

(52) U.S. Cl. ..... 439/344

(58) Field of Classification Search ..... 439/344, 439/354, 352, 418

See application file for complete search history.

(56) References Cited

U.S. PATENT DOCUMENTS 5,169,329 A * 12/1992 Taguchi ..... 439/188
5,299,956 A 4/1994 Brownell et al.
5,538,438 A * 7/1996 Orlando ..... 439/344
5,967,801 A 10/1999 Martin et al.
5,967,828 A 10/1999 Geurts et al.
5,971,812 A 10/1999 Martin
5,993,237 A * 11/1999 Kern et al. ..... 439/344
6,019,521 A 2/2000 Manning et al.
6,174,190 B1 * 1/2001 Tharp et al. ..... 439/352
6,210,200 B1 4/2001 Kranzdorf
6,254,418 B1 * 7/2001 Tharp et al. ..... 439/352
6,322,386 B1 * 11/2001 Tharp et al. ..... 439/344
6,364,685 B1 * 4/2002 Manning ..... 439/357
6,398,576 B1 * 6/2002 Hwang et al. ..... 439/354
6,506,070 B1 * 1/2003 Huang ..... 439/352
6,574,586 B1 6/2003 David et al.
6,783,402 B2 * 8/2004 Chen ..... 439/676
6,821,024 B2 * 11/2004 Bates, III ..... 385/76
6,863,556 B2 * 3/2005 Viklund et al. ..... 439/354
6,918,782 B2 * 7/2005 Foster ..... 439/352
2003/0190123 A1 10/2003 Kahle et al.
2003/0220008 A1 * 11/2003 Viklund et al. ..... 439/352
2004/0047565 A1 3/2004 Chang et al.
2005/0124201 A1 * 6/2005 Lo et al. ..... 439/352

FOREIGN PATENT DOCUMENTS

EP 0 849 602 6/1998
EP 1 271 708 1/2003
EP 1 533 872 A1 5/2005

* cited by examiner

*Primary Examiner*—Gary Paumen

(57) ABSTRACT

The present disclosure relates to modular plugs including a housing for holding a plurality of terminals that are engageable with contacts of a mating plug receptacle. The modular plug further includes a slider latch having a distal end portion integrally formed with the housing, a proximal end portion configured and adapted for operative engagement with the housing, and an intermediate portion disposed between the distal end portion and the proximal end portion. The intermediate portion defines at least one flex point. Accordingly, when the proximal end portion of the slider latch is operatively connected to the housing, the intermediate portion of the slider latch defines an anti-snag feature. The slider latch facilitates locking and unlocking of the modular plug with a plug receptacle when in a densely packed array.

18 Claims, 11 Drawing Sheets

MODULAR PLUG WITH SLIDER LATCH

BACKGROUND

1. Technical Field

The present disclosure relates to modular plugs and, more particularly, to modular plugs including a slider latch capable of locking and un-locking the modular plug to a corresponding receptacle.

2. Background of Related Art

Modular plugs and modular jacks are commonly used for interconnecting a plurality of wires in communications systems. Various latching mechanisms and the like have been developed and incorporated into electrical, data and/or telephonic cable connectors or plugs for mechanically connecting the modular plug to a corresponding complementary receptacle. Typically, in order to release the plug from the receptacle an individual must squeeze, depress or otherwise manipulate the latching mechanism in order to release the modular plug from the receptacle.

In densely packed arrays of receptacles, manipulation of the latching mechanism, for the modular plugs connected to substantially the centrally located receptacles of the array, is greatly hindered and impaired as compared to manipulation of the latching mechanisms for modular plugs located around the periphery of the array. Typically, in order to manipulate the latching mechanism and unplug the centrally located plugs from the receptacle array, it is not uncommon to have to first unplug and/or remove the perimetral array of modular plugs in order to gain sufficient access to the latching mechanisms of the centrally located plugs. Additionally, at times, when unplugging and/or removing the modular plug from the receptacle array, the modular plug may snag and/or get caught on adjacent modular plugs or the like.

Accordingly, a need exists for modular plugs including latch mechanisms or the like which facilitate connection and disconnection of plugs into/from corresponding receptacles.

SUMMARY

The present disclosure relates to modular plugs and the like. According to one aspect of the present disclosure, a modular plug is provided including a housing for holding a plurality of terminals that are engageable with contacts of a mating plug receptacle. The housing defines a cavity which is open to the terminals and is configured and adapted to receive a plurality of wires therein. The modular plug further includes a slider latch having a distal end portion integrally formed with the housing, a proximal end portion configured and adapted for operative engagement with the housing, and an intermediate portion disposed between the distal end portion and the proximal end portion. The intermediate portion defines at least one flex point. Accordingly, when the proximal end portion of the slider latch is operatively connected to the housing, the intermediate portion of the slider latch defines an anti-snag feature.

The proximal end portion of the slider latch may be slidingly connected to the housing. The intermediate portion of the slider latch may include a pair of flex points including a distal flex point formed in an inner surface thereof and a proximal flex point formed in an outer surface thereof. The distal end portion of the slider latch may include at least one shoulder for selectively engaging a complementary shoulder provided on the plug receptacle.

The proximal end portion of the slider latch may include at least one dovetail projecting therefrom for selective engagement in a complementary channel formed in the housing. The proximal end portion of the slider latch may further include finger grips.

The housing may include a first-half portion and a second-half portion in selective operative association with one another. The first-half portion may include a base wall and a pair of upstanding spaced apart side walls; and the second-half-portion may include a base wall and a pair of upstanding spaced apart side walls. Each of the side walls of the first-half portion may include an elongate slot formed therein, and each of the side walls of the second-half portion may include a tab projecting therefrom, wherein the tabs are configured and dimensioned to selectively engage a respective elongate slot of the first-half portion.

Desirably, at least the housing is fabricated from dielectric material.

It is envisioned that when the modular plug is connected to the plug receptacle, movement of the proximal end portion of the slider latch, relative to the housing, results in disengagement of the shoulders of the distal end portion of the slider latch from the shoulders of the plug receptacle.

According to another aspect of the present disclosure, a modular plug for connection to a complementary plug receptacle is provided. The modular plug includes a housing supporting at least one terminal for electrical connection with a contact of the plug receptacle; and a slider latch including a distal end portion operatively connected to the housing, a proximal end portion configured and adapted for operative inter-engagement with the housing, and a flexible intermediate portion disposed between the distal end portion and the proximal end portion. Accordingly, when the proximal end portion of the slider latch is operatively connected to the housing, the intermediate portion of the slider latch bends to define an anti-snag feature.

In an embodiment, the proximal end portion of the slider latch may be slidingly connected to the housing. The intermediate portion of the slider latch may include a pair of flex points including a distal flex point formed in an inner surface thereof and a proximal flex point formed in an outer surface thereof. The distal end portion of the slider latch may include at least one shoulder for selectively engaging a complementary shoulder provided on the plug receptacle. The proximal end portion of the slider latch may include at least one dovetail projecting therefrom for selective engagement in a complementary channel formed in the housing.

The housing may include a first-half portion and a second-half portion in selective operative association with one another. The first-half portion may include a base wall and a pair of upstanding spaced apart side walls; and the second-half-portion may include a base wall and a pair of upstanding spaced apart side walls. Each of the side walls of the first-half portion may include an elongate slot formed therein, and each of the side walls of the second-half portion may include a tab projecting therefrom, wherein the tabs are configured and dimensioned to selectively engage a respective elongate slot of the first-half portion.

Desirably, when the modular plug is connected to the plug receptacle, movement of the proximal end portion of the slider latch, relative to the housing, results in disengagement of the shoulders of the distal end portion of the slider latch from the shoulders of the plug receptacle.

According to yet another aspect of the present disclosure, a modular plug for terminating a plurality of electrical wires and for electrically mating with a complementary plug receptacle is provided. The modular plug includes a housing for holding a plurality of terminals that are engageable with contacts of a mating plug receptacle, the housing defining a cavity which is open to the terminals and is configured and adapted to receive a plurality of wires therein. The housing includes a first-half portion having a base wall and a pair of upstanding spaced apart side walls, wherein each of the side walls of the first-half portion includes an elongate slot formed therein; and a second-half portion in selective operative association with the first-half portion, the second-half portion having a base wall and a pair of upstanding spaced apart side walls, wherein each of the side walls of the second-half portion includes a tab projecting therefrom. The tabs are configured and dimensioned to selectively engage a respective elongate slot of the first-half portion.

The modular plug further includes a slider latch having a distal end portion integrally formed with the housing, wherein the distal end portion of the slider latch includes at least one shoulder for selectively engaging a complementary shoulder provided on the plug receptacle; a proximal end portion configured and adapted for sliding engagement with the housing; and an intermediate portion disposed between the distal end portion and the proximal end portion. The intermediate portion of the slider latch includes a pair of flex points including a distal flex point formed in an inner surface thereof and a proximal flex point formed in an outer surface thereof. Accordingly, when the proximal end portion of the slider latch is operatively connected to the housing, the intermediate portion of the slider latch defines an anti-snag feature.

The proximal end portion of the slider latch may include at least one dovetail projecting therefrom for selective engagement in a complementary channel formed in the housing. The proximal end portion of the slider latch may include finger grips.

It is envisioned that at least the housing is fabricated from dielectric material.

In use, when the modular plug is connected to the plug receptacle, movement of the proximal end portion of the slider latch, relative to the housing, results in disengagement of the shoulders of the distal end portion of the slider latch from the shoulders of the plug receptacle.

For a better understanding of the present invention and to show how it may be carried into effect, reference will now be made by way of example to the accompanying drawings.

DETAILED DESCRIPTION OF THE DRAWINGS

DETAILED DESCRIPTION OF THE EMBODIMENTS

Figure 1:
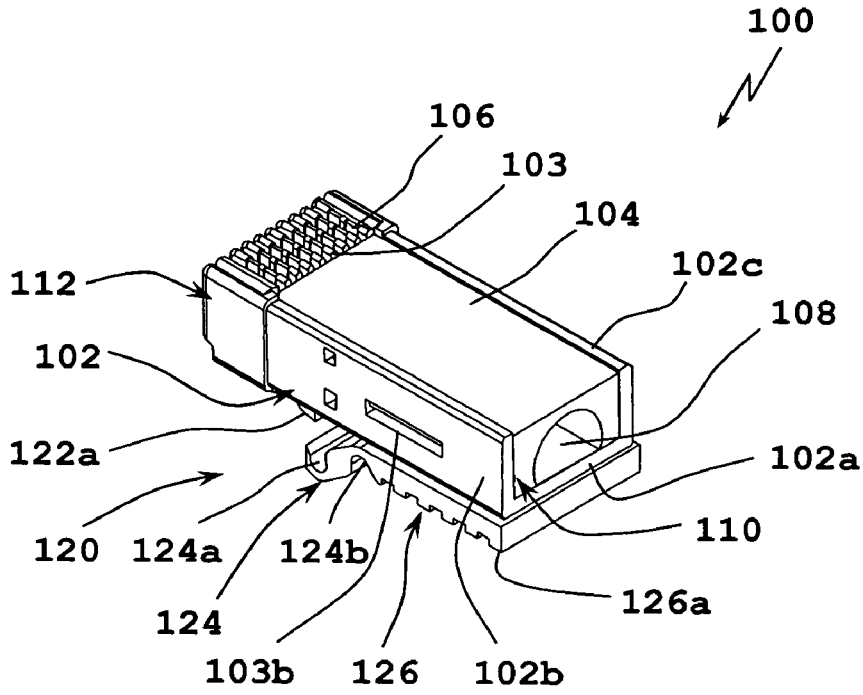
FIG. 1 is a top, rear perspective view of a modular plug according to an embodiment of the present disclosure.
Figure 2:
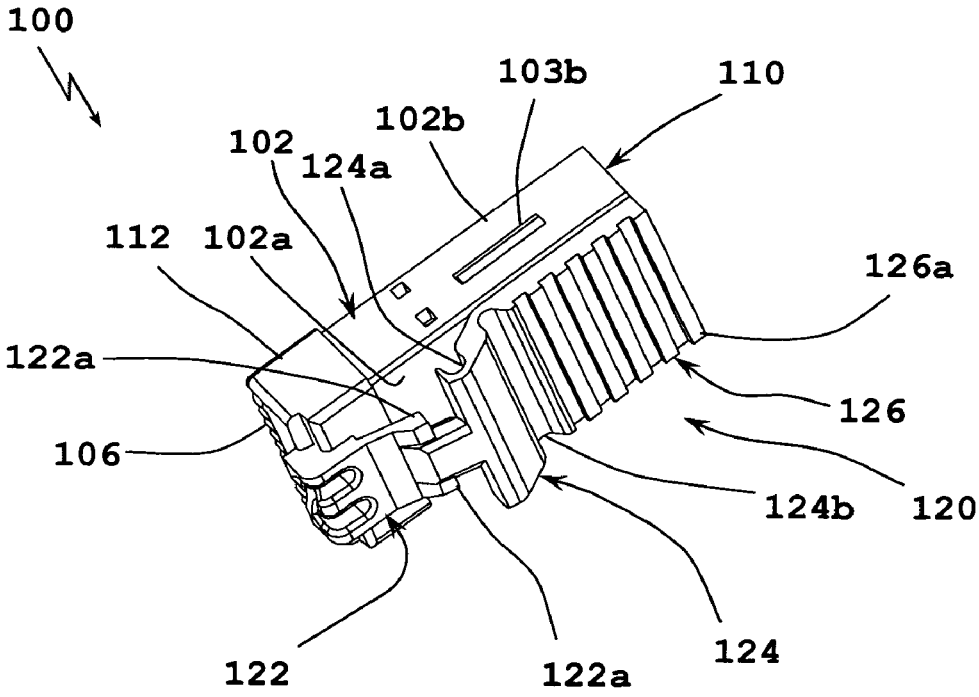
FIG. 2 is a bottom, front perspective view of the modular plug of FIG. 1.
Figure 3:
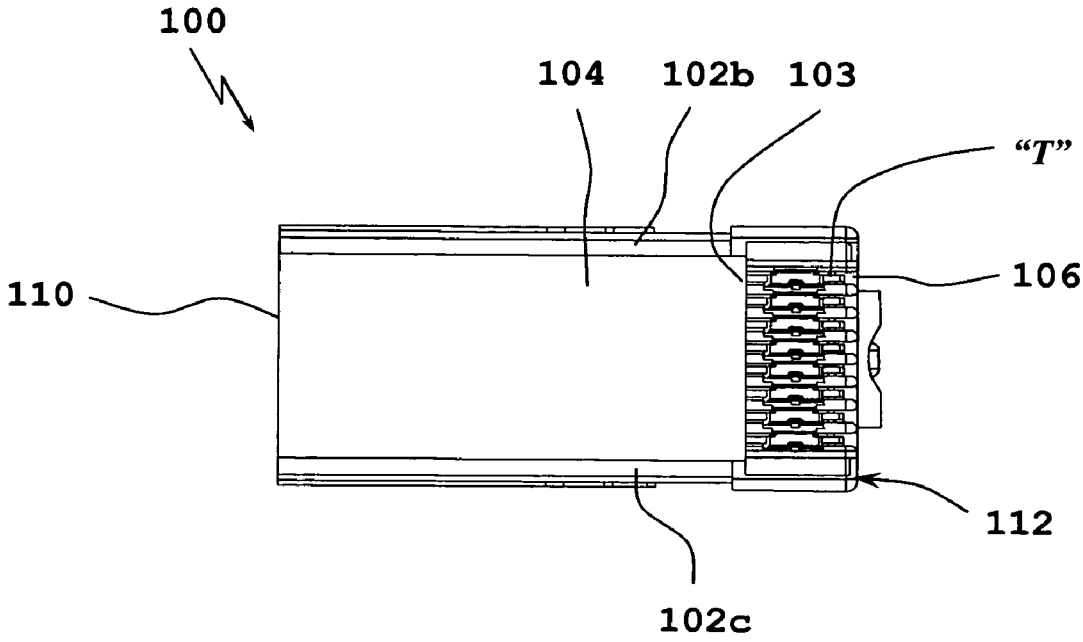
FIG. 3 is a top plan view of the modular plug of FIGS. 1 and 2.
Figure 4:
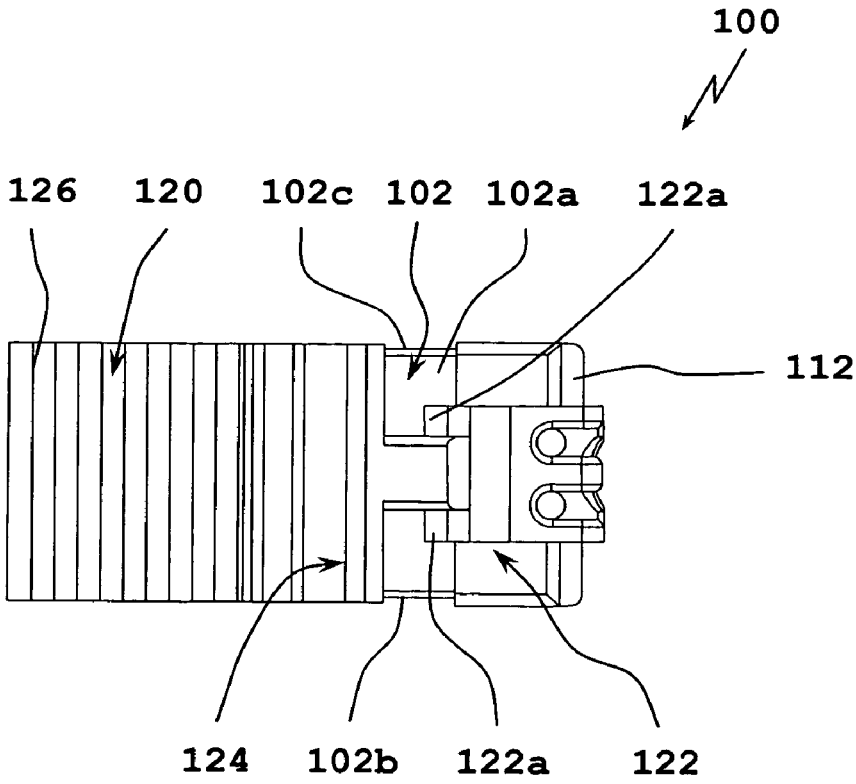
FIG. 4 is a bottom, plan view of the modular plug of FIGS. 1-3.
Figure 5:
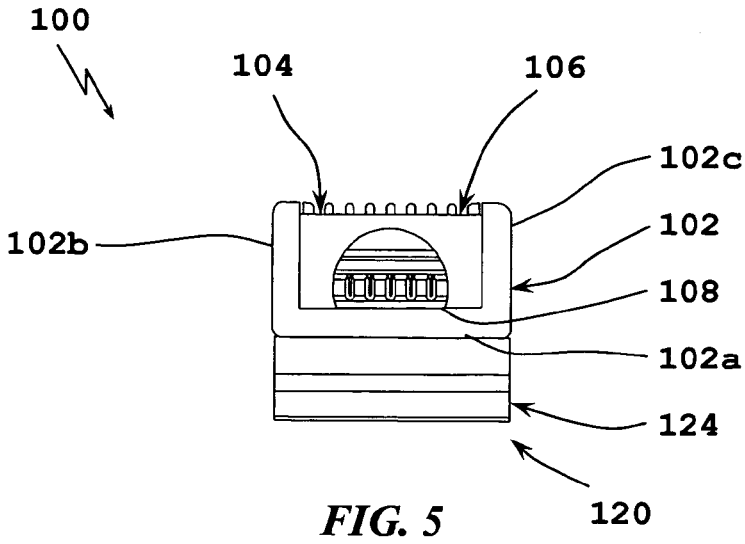
FIG. 5 is a rear, elevational view of the modular plug of FIGS. 1-4.
Figure 6:
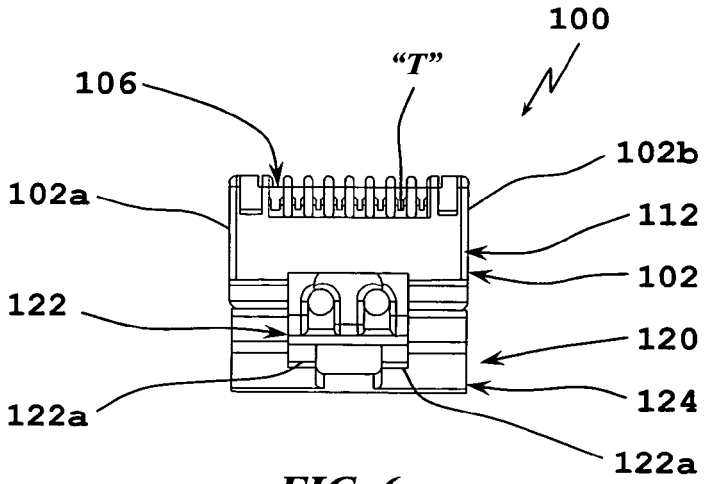
FIG. 6 is a front, elevational view of the modular plug of FIGS. 1-5.
Figure 7:
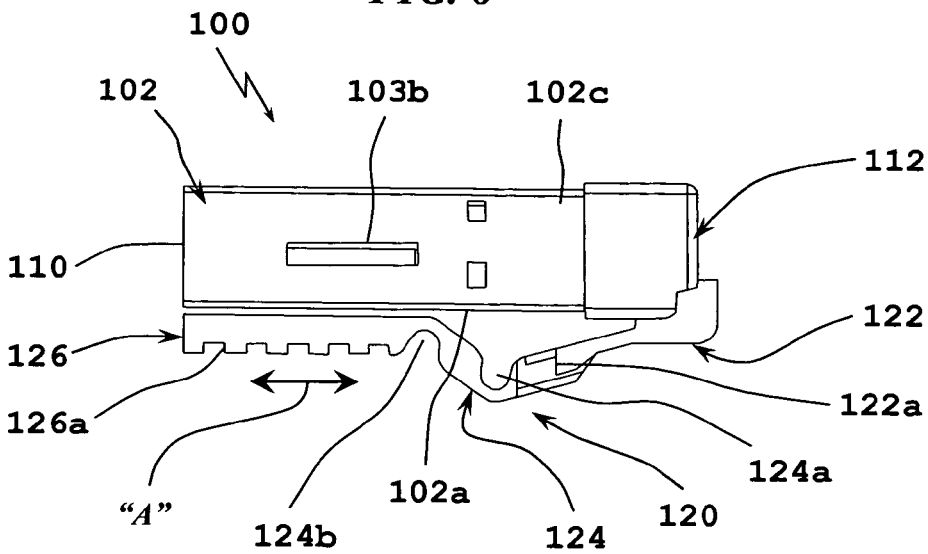
FIG. 7 is a side, elevational view of the modular plug of FIGS. 1-6.
Figure 8:
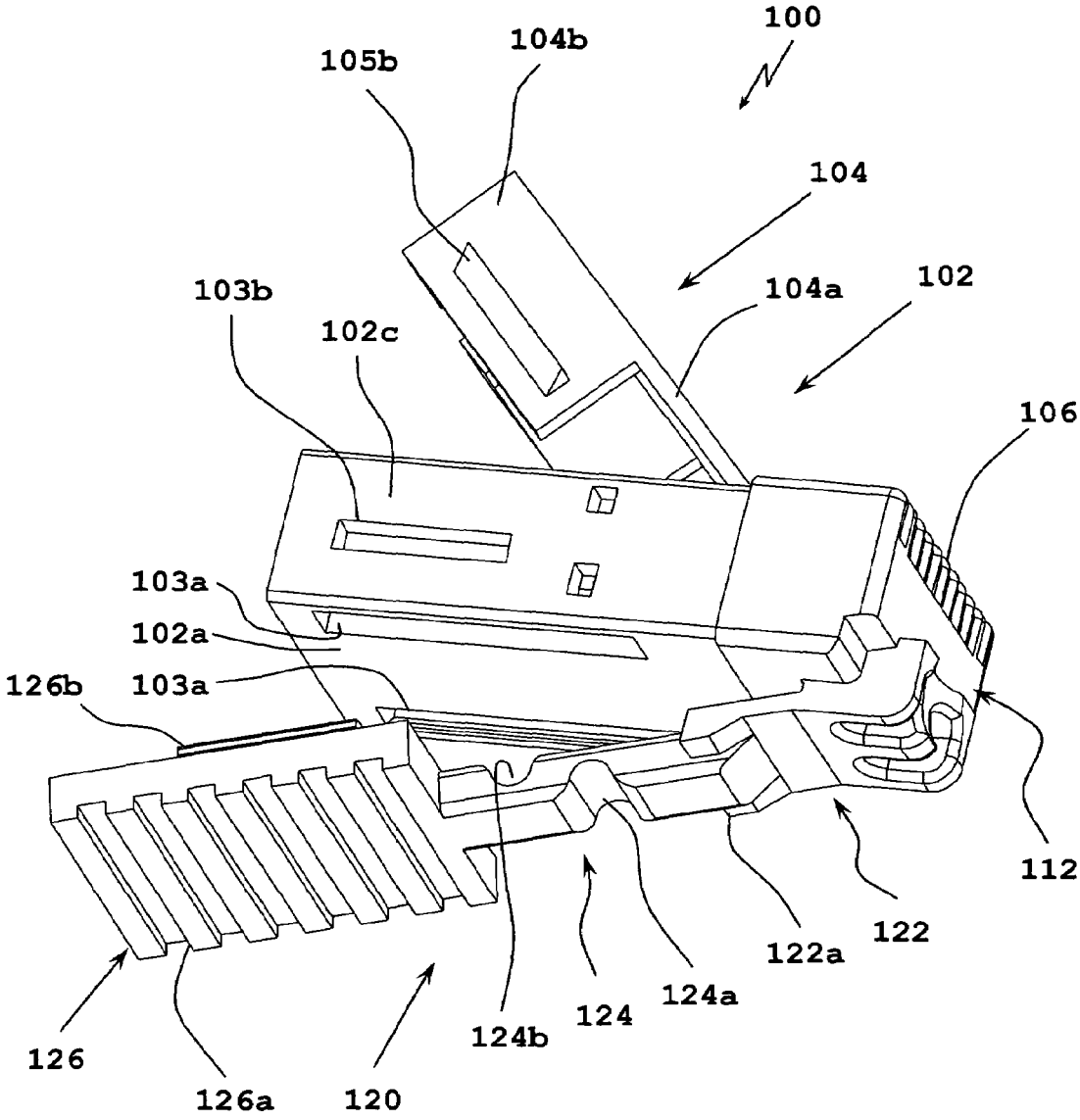
FIG. 8 is a bottom, front perspective view of a first-half portion of a housing of the modular plug of FIGS. 1-7, illustrating the slider in an un-connected condition.
Figure 9:
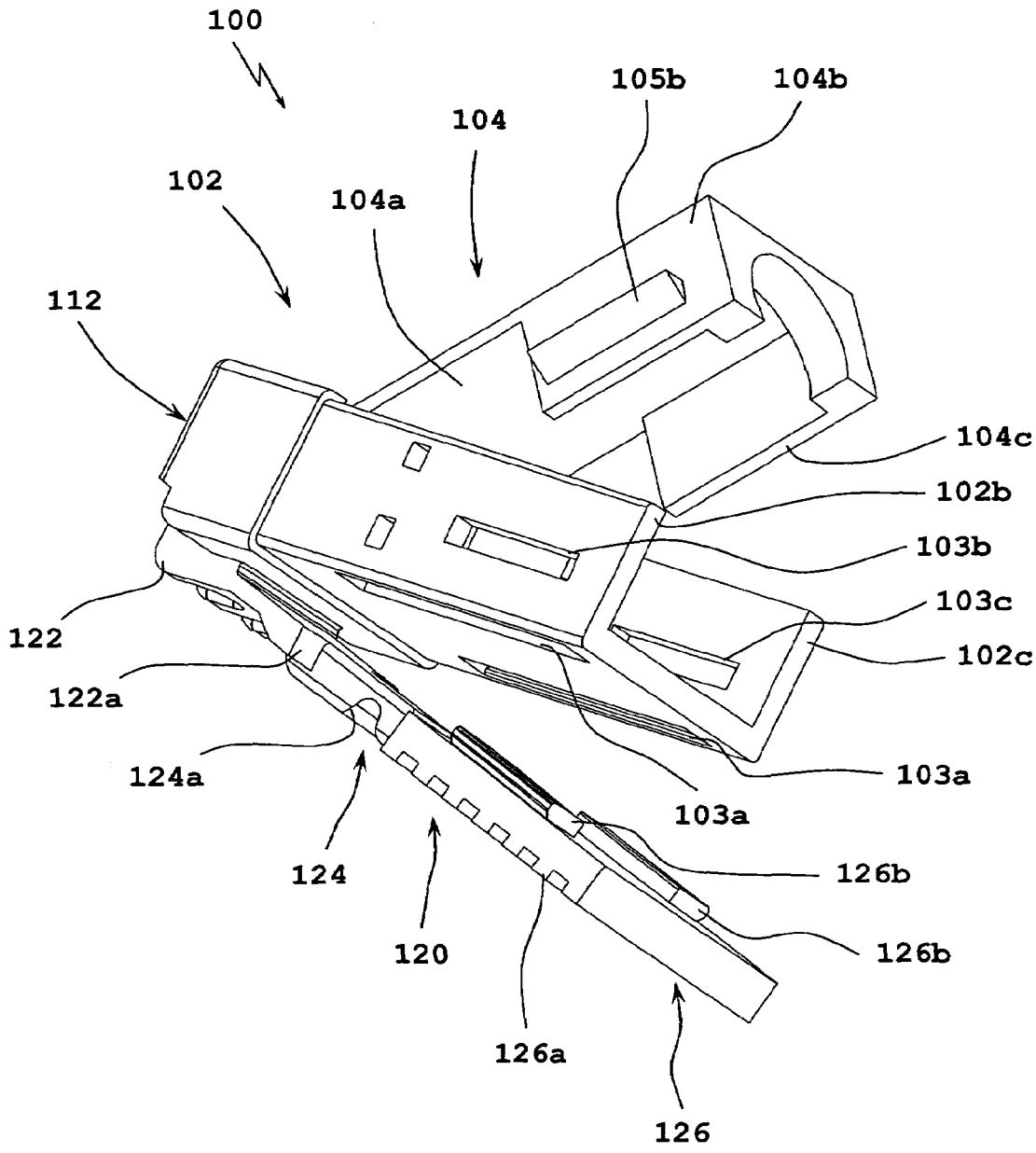
FIG. 9 is a bottom, rear perspective view of the first-half portion of the housing of FIG. 8.
Figure 10:
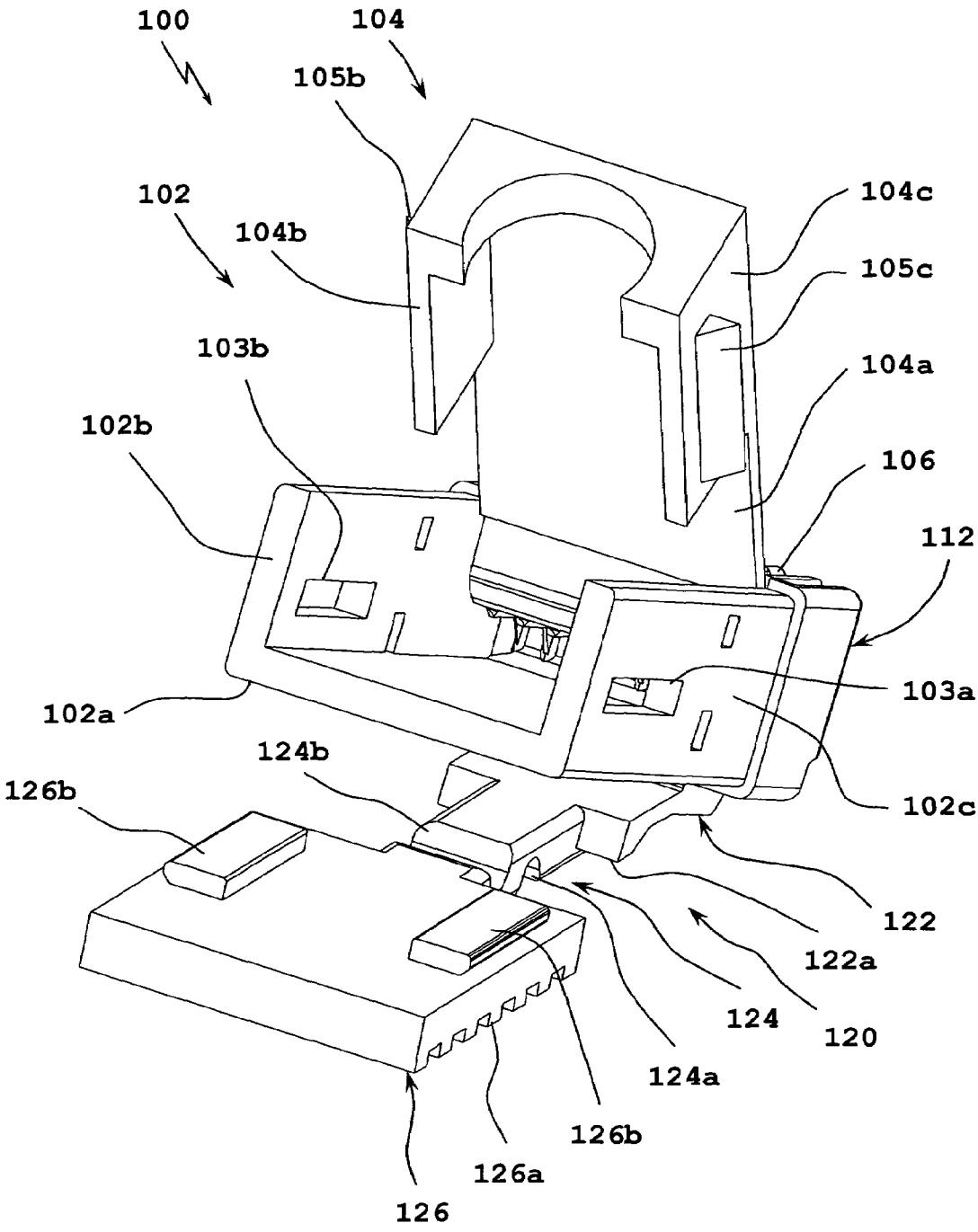
FIG. 10 is top, rear perspective view of the first-half portion of the housing of FIGS. 8 and 9.
Figure 11:
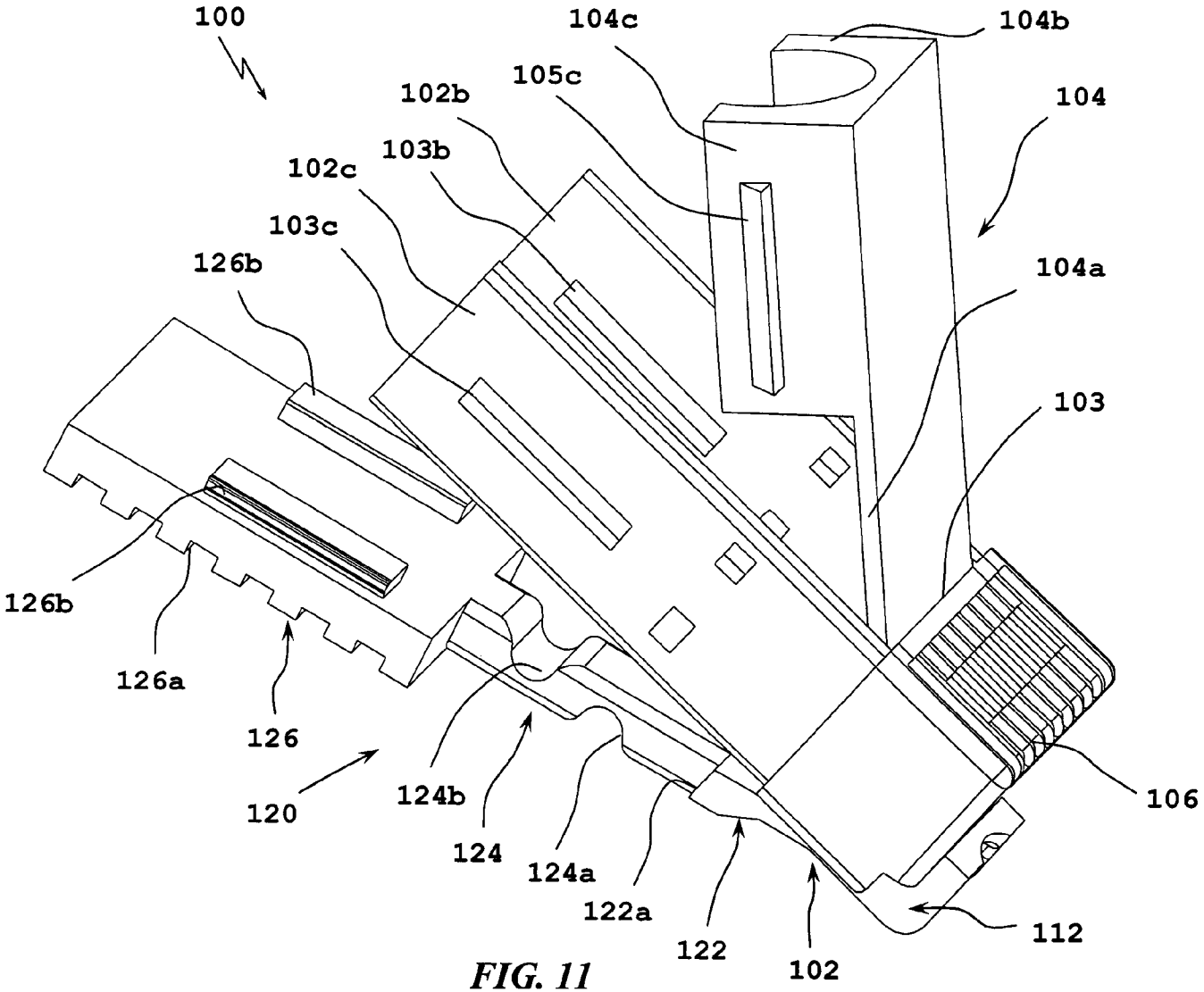
FIG. 11 is a top, front perspective view of the first-half portion and the second-half portion of the housing of FIG. 10.
Figure 12:
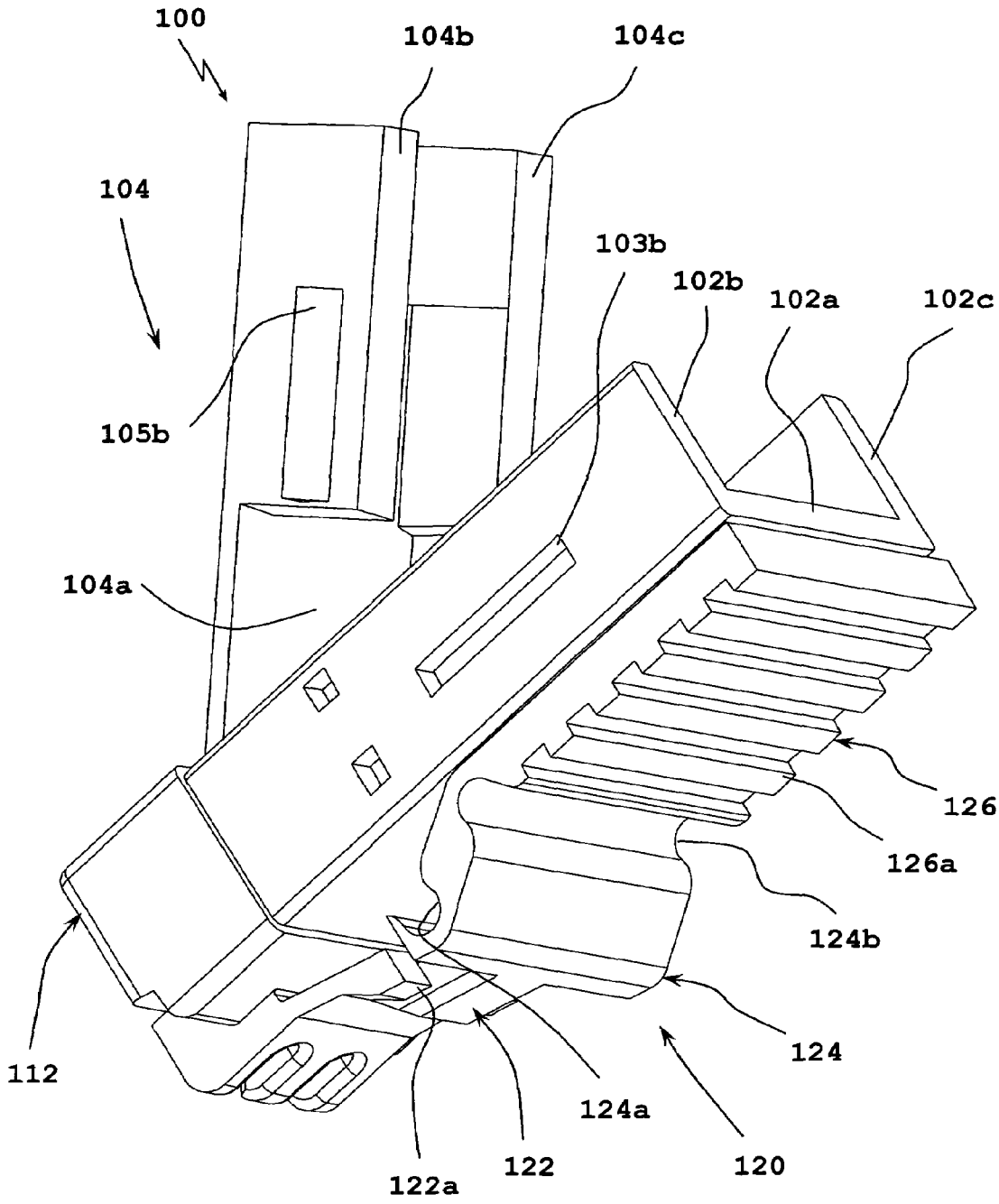
FIG. 12 is a bottom, rear perspective view of the first-half portion and the second-half portion of the housing of FIGS. 10 and 11, illustrating the slider in a connected condition.

Embodiments of the presently disclosed modular plugs will now be described in detail with reference to the drawing figures wherein like reference numerals identify similar or identical elements. As used herein and as is traditional, the term "distal" refers to that portion which is furthest from the user while the term "proximal" refers to that portion which is closest to the user. In addition, terms such as "above", "below", "forward", "rearward", etc. refer to the orientation of the figures or the direction of components and are simply used for convenience of description.

Referring initially to FIGS. 1-12, a modular plug (e.g., electrical connector, data connector, telephonic connector, etc.), for selective connection to a complementary receptacle (not shown), is generally designated as 100. Modular plug 100 is matable with a plug receptacle 200 (see FIGS. 13-18) for interconnecting a plurality of wires (not shown) or the like. Modular plug 100, as described herein, is an eight position modular plug for use with an eight wire communications cable. However, it should be understood that the invention can also be applied to other connectors which are terminable to different numbers of wires.

Modular plug 100 is desirably constructed of dielectric material and includes a housing defined by a first-half portion 102 and second-half portion 104 in selective operative association with one another. In an embodiment, as seen in FIGS. 1, 3, 12, 14, first-half portion 102 and second-half portion 104 are connected to one another via a living hinge 103. First-half portion 102 and second-half portion 104 of modular plug 100 are configured and adapted to hold a plurality of terminals "T" that are arranged in side-by-side relationship in respective slots 106. Modular plug 100 defines a cavity 108 which opens into the modular plug from a wire-receiving end 110 of the modular plug 100, and extends through to slots 106 at a termination end 112 of modular plug 100.

First-half portion 102 includes a base wall 102*a* and a pair of upstanding, spaced apart side walls 102*b*, 102*c*. Base wall 102*a* includes at least one, preferably a pair of longitudinally extending channels or slots 103*a* formed therein (see FIGS. 8, 9 and 12). Meanwhile, each side wall 102*b*, 102*c* of first-half portion 102 includes a respective, longitudinally extending, elongate slot 103*b*, 103*c* formed therein.

As seen in FIGS. 8-12, second-half portion 104 includes a base wall 104*a* and a pair of upstanding, spaced apart side walls 104*b*, 104*c*. Each side wall 104*b*, 104*c* of second-half portion 104 includes a respective tab, projection or the like 105*b*, 105*c* extending therefrom. Each tab 105*b*, 105*c* is configured and dimensioned to cooperatingly mate with a respective slot 103*b*, 103*c* formed in side walls 102*b*, 102*c* of first-half portion 102, when second-half portion 104 is closed down onto first-half portion 102.

In operation, when second-half portion 104 is closed down onto first-half portion 102, tabs 105*b*, 105*c* of second-half portion 104 snap into or otherwise operatively engage slots 103*b*, 103*c* formed in first-half portion 102.

Figure 18:
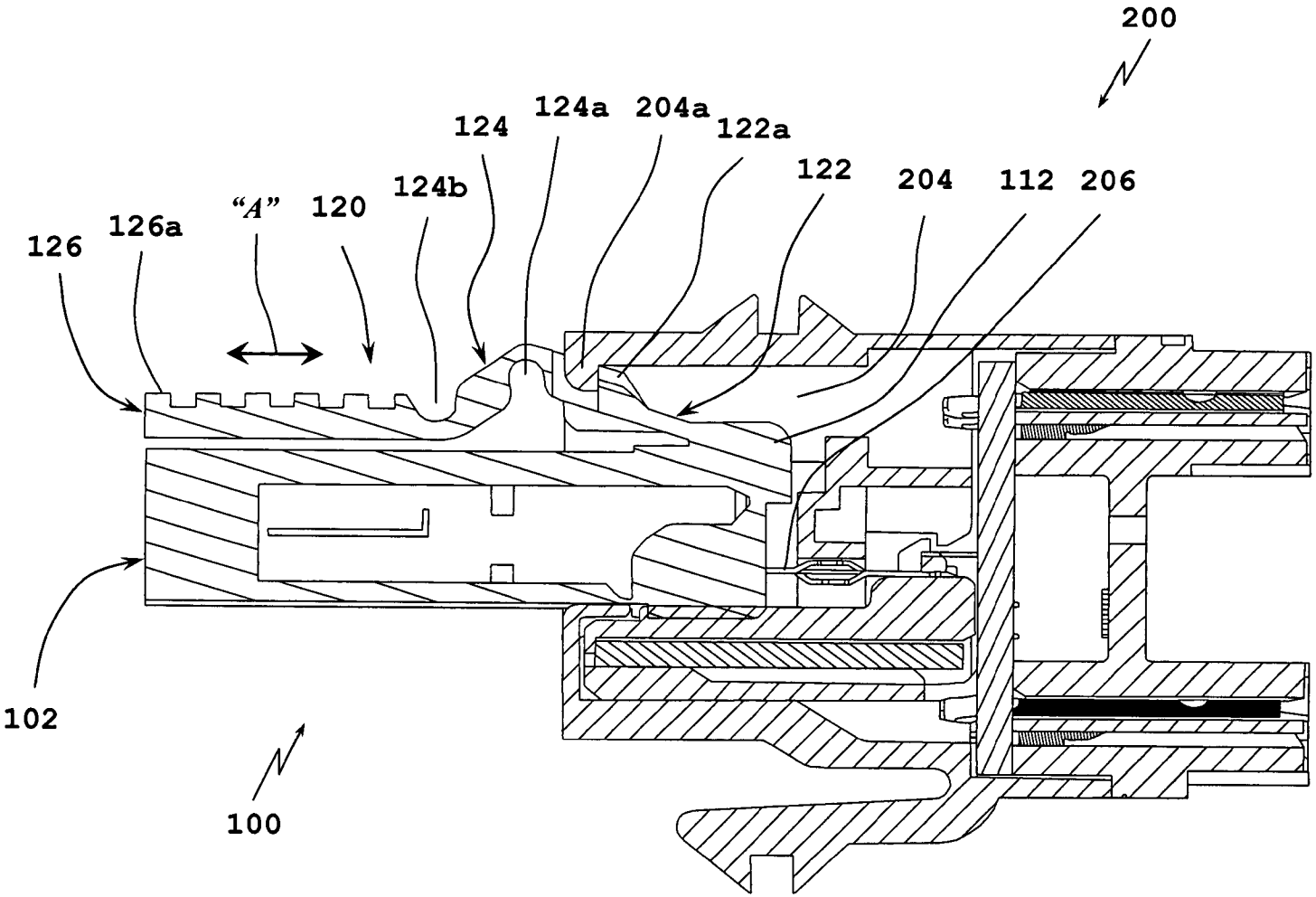
FIG. 18 is a longitudinal, cross-sectional view of the plug receptacle of FIGS. 14-17, including the modular plug of FIGS. 1-12 operatively connected thereto, as taken through 18-18 of FIG. 16.

As seen in FIGS. 1-12, first-half portion 102 of modular plug 100 includes a slider latch 120 operatively associated therewith. Slider latch 120 includes a distal end portion 122 connected to or near termination end 112 of modular plug 100. Distal end portion 122 of slider latch 120 extends in a proximal direction at an angle relative to base wall 102*a* of first-half portion 102. Distal end portion 122 of slider latch 120 defines at least one, preferably, a pair of shoulders 122*a* for engaging a surface of a plug receptacle 200 (see FIG. 13) and for securely engaging and mating modular plug 100 with the plug receptacle 200, as seen in FIG. 18.

Slider latch 120 includes an intermediate portion 124 integrally connected to or formed with distal end portion 122. Intermediate portion 124 includes at least a pair of flex points or integral/living hinges 124*a*, 124*b* formed therein. Desirably, a distal flex point 124*a* is formed along an inner surface of intermediate portion 124 and a proximal flex point 124*b* is formed along an outer surface of intermediate portion 124.

Slider latch 120 further includes a proximal end portion 126 integrally connected to or formed with intermediate portion 124. Proximal end portion 126 of slider latch 120 includes finger grips 126*a* formed along an outer surface thereof for increasing the ergonomics and ease of use of modular plug 100. Proximal end portion 126 of slider latch 120 further includes at least one, preferably a pair of dovetails or rails 126*b* extending longitudinally from an inner surface thereof. Dovetails 126*b* are configured and dimensioned to complement and snap-fit engage the respective slots or channels 103*a* formed in base wall 102*a* of first-half portion 102. Desirably, dovetails 126*b* and channels 103*a* are configured and dimensioned such that when proximal end portion 126 of slider latch 120 is operatively engaged with first-half portion 102, proximal end portion 126 of slider latch 120 may reciprocatingly slide longitudinally with respect to first-half portion 102, as indicated by arrow "A" in FIGS. 7 and 18.

In use, when proximal end portion 126 of slider latch 120 is operatively engaged with first-half portion 102, intermediate portion 124 of slider latch 120 folds and bends along flex pointes 124*a*, 124*b* to define an anti-snag feature or the like. In this manner, if the cord or cable to which modular plug 100 is attached is pulled on, to remove the cable from an installation, the anti-snag feature enables modular plug 100 to navigate through the bundles (e.g., nest or web) of remaining cables without becoming snagged or hooked thereon.

Figure 13:
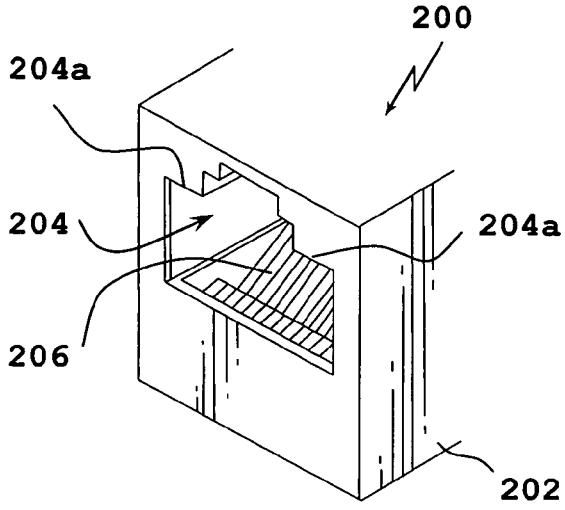
FIG. 13 is a schematic perspective view of a modular plug receiving end portion of a prior art plug receptacle.
Figure 14:
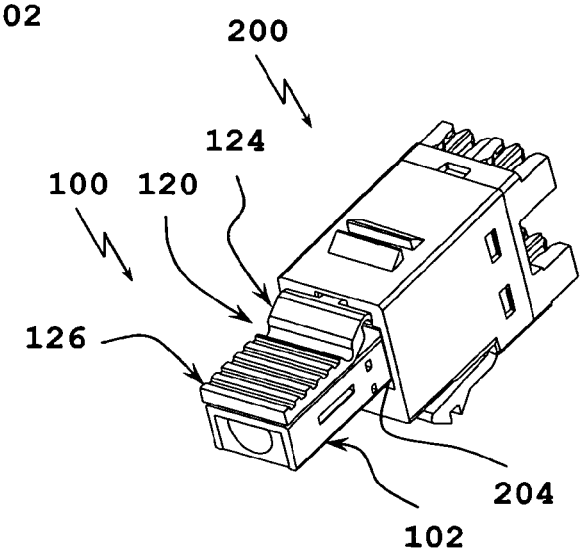
FIG. 14 is a bottom, front perspective view of a plug receptacle including the receiving end portion of FIG. 8, illustrating the modular plug of FIGS. 1-12 operatively connected thereto.
Figure 15:
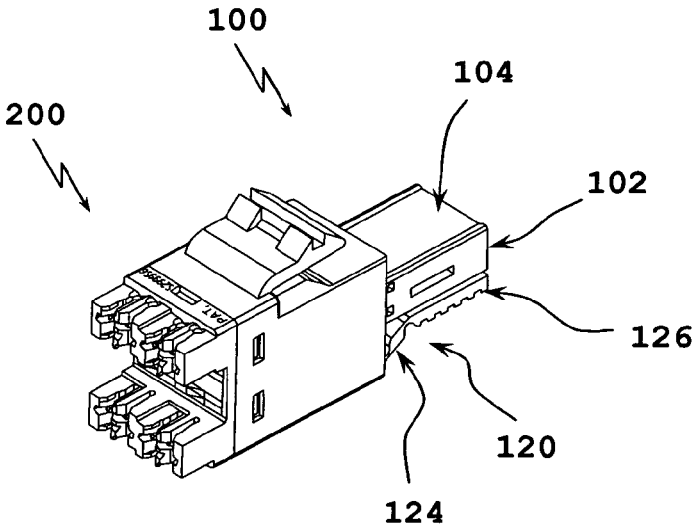
FIG. 15 is a top, rear perspective view of the plug receptacle of FIG. 14, illustrating the modular plug of FIGS. 1-12 operatively connected thereto.
Figure 16:
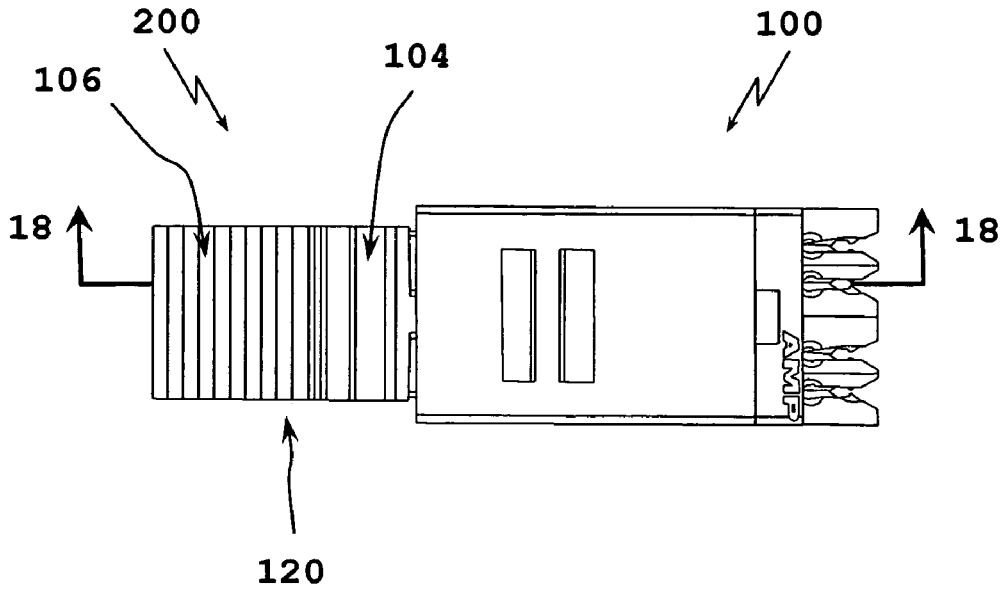
FIG. 16 is a bottom, plan view of the plug receptacle of FIG. 14, illustrating the modular plug of FIGS. 1-12 operatively connected thereto.
Figure 17:
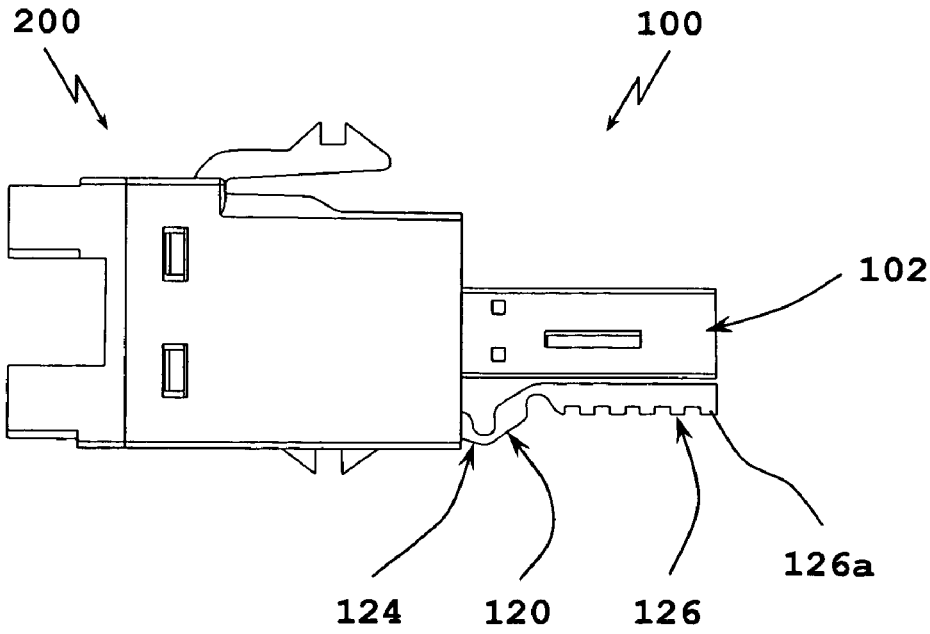
FIG. 17 is a side elevational view of the plug receptacle of FIG. 14, illustrating the modular plug of FIGS. 1-12 operatively connected thereto.

Modular plug 100 is selectively connectable to a plug receptacle 200, as seen in FIG. 13. Plug receptacle 200 includes a housing 202 defining an opening 204 configured and adapted to receive termination end 112 of modular plug 100 therein. In particular, opening 204 of plug receptacle 200 defines shoulders 204*a* configured and adapted to engage shoulders 122*a* of slider latch 120 of modular plug 100 when modular plug 100 is mated with plug receptacle 200. As is conventional, plug receptacle 200 includes a plurality of contact or conductors 206 disposed within housing 202 for electrically connecting with terminals "T" of modular plug 100.

As seen in FIGS. 14-18, modular plug 100 is shown mated with plug receptacle 200. In order to mate modular jack 100 with plug receptacle 200, proximal end portion 126 of slider latch 120 of modular plug 100 is connected to first-half portion 102 of modular plug 100. With modular plug 100 so configured, termination end 112 of modular plug 100 is inserted into or otherwise introduced into opening 204 of plug receptacle 200. As modular plug 100 is mated with plug receptacle 200, shoulders 122*a* of slider latch 120 engage and are cammed or urged toward first-half portion 102 by shoulders 204*a* of opening 204 for a snap-fit engagement.

In order to disconnect modular plug 100 from plug receptacle 200, proximal end portion 126 of slider latch 120 is moved in a proximal direction, as indicated by arrow "A" in FIG. 18, thereby moving intermediate portion 124 in the direction of first-half portion 102 of modular plug 100. In so doing, shoulders 122*a* of slider latch 120 disengage shoulders 204*a* of housing 202 of plug receptacle 200 thereby allowing modular plug 100 to be pulled from plug receptacle 200.

Upon moving proximal end portion 126 of slider latch 120 in a proximal direction, distal end portion 122 of slider latch 120 is biased toward first-half portion 102 of modular plug 100. Since dovetails 126*b* of proximal end portion 126 of slider latch 120 hold proximal end portion 126 in sliding engagement with first-half portion 102 of modular plug 100, upon release of proximal end portion 126 of slider latch 120 distal end portion 122 of slider latch 120 returns to the un-biased condition.

It is to be understood that the foregoing description is merely a disclosure of particular embodiments and is no way intended to limit the scope of the invention. Other possible modifications will be apparent to those skilled in the art and all modifications are to be defined by the following claims.

What is claimed is:

1. A modular plug, comprising:

a housing for holding a plurality of terminals that are engageable with contacts of a mating plug receptacle, the housing defining a cavity which is open to the terminals and is configured and adapted to receive a plurality of wires therein; and a slider latch including a distal end portion integrally formed with a surface of the housing, a proximal end portion configured and adapted for operative engagement with the housing, and an intermediate portion disposed between the distal end portion and the proximal end portion, the intermediate portion defining at least one flex point;

wherein when the proximal end portion of the slider latch is operatively connected to the housing, the intermediate portion of the slider latch is bent about the at least one flex point such that at the flex point the intermediate portion extends a greater distance from the surface of the housing than the distal and proximal end portions of the slider latch.

2. The modular plug according to claim 1, wherein the proximal end portion of the slider latch is slidingly connected to the housing.

3. The modular plug according to claim 1, wherein the intermediate portion of the slider latch includes a pair of flex points including a distal flex point formed in an inner surface thereof and a proximal flex point formed in an outer surface thereof.

4. The modular plug according to claim 1, wherein the distal end portion of the slider latch includes at least one shoulder for selectively engaging a complementary shoulder provided on the plug receptacle.

5. The modular plug according to claim 1, wherein the proximal end portion of the slider latch includes at least one dovetail projecting therefrom for selective engagement in a complementary channel formed in the housing.

6. The modular plug according to claim 1, wherein the proximal end portion of the slider latch includes finger grips.

7. The modular plug according to claim 4, wherein when the modular plug is connected to the plug receptacle, movement of the proximal end portion of the slider latch, relative to the housing, results in disengagement of the shoulders of the distal end portion of the sLider latch from the shoulders of the plug receptacle.

8. A modular plug for connection to a complementary plug receptacle, the modular plug comprising:

a housing supporting at least one terminal for electrical connection with a contact of the plug receptacle; and a slider latch including a distal end portion operatively connected to the housing, a proximal end portion configured and adapted for operative inter-engagement with the housing wherein the proximal end portion is slidingly connected to the housing such that the proximal end portion is configured to move along the housing away from the distal end portion, and a flexible intermediate portion disposed between the distal end portion and the proximal end portion;

wherein when the proximal end portion of the slider latch is operatively connected to the housing, the intermediate portion of the slider latch bends to define an anti-snag feature.

9. The modular plug according to claim 8, wherein the intermediate portion of the slider latch includes a pair of flex points including a distal flex point formed in an inner surface thereof and a proximal flex point formed in an outer surface thereof, and wherein the distal end portion of the slider latch includes at least one shoulder for selectively engaging a complementary shoulder provided on the plug receptacle.

10. The modular plug according to claim 8, wherein the proximal end portion of the slider latch includes at least one dovetail projecting therefrom for selective engagement in a complementary channel formed in the housing.

11. The modular plug according to claim 8, wherein the housing includes a first-half portion and a second-half portion in selective operative association with one another, wherein the first-half portion includes a base wall and a pair of upstanding spaced apart side walls, and the second-half-portion includes a base wall and a pair of upstanding spaced apart side walls.

12. The modular plug according to claim 8, wherein the distal end portion, the proximal end portion, and the intermediate portion of the slider latch are integrally formed such that the slider latch is of a one-piece construction.

13. The modular plug according to claim 11, wherein each of the side walls of the first-half portion includes an elongate slot formed therein, and each of the side walls of the second-half portion includes a tab projecting therefrom, wherein the tabs are configured and dimensioned to selectively engage a respective elongate slot of the first-half portion.

14. The modular plug according to claim 9, wherein when the modular plug is connected to the plug receptacle, movement of the proximal end portion of the slider latch, relative to the housing, results in disengagement of the shoulders of the distal end portion of the slider latch from the shoulders of the plug receptacle.

15. A modular plug for terminating a plurality of electrical wires and for electrically mating with a complementary plug receptacle, the modular plug comprising:

a housing for holding a plurality of terminals that are engageable with contacts of a mating plug receptacle, the housing defining a cavity which is open to the terminals and is configured and adapted to receive a plurality of wires therein, the housing including:

a first-half portion having a base wall and a pair of upstanding spaced apart side walls, wherein each of the side walls of the first-half portion includes an elongate slot formed therein; and a second-half portion in selective operative association with the first-half portion, the second-half portion having a base wall and a pair of upstanding spaced apart side walls, wherein each of the side walls of the second-half portion includes a tab projecting therefrom, wherein the tabs are configured and dimensioned to selectively engage a respective elongate slot of the first-half portion;

a slider latch including:

a distal end portion integrally formed with the housing, wherein the distal end portion of the slider latch includes at least one shoulder for selectively engaging a complementary shoulder provided on the plug receptacle;

a proximal end portion configured and adapted for sliding engagement with the housing; and an intermediate portion disposed between the distal end portion and the proximal end portion, the intermediate portion of the slider latch includes a pair of flex points including a distal flex point formed in an inner surface thereof and a proximal flex point formed in an outer surface thereof;

wherein when the proximal end portion of the slider latch is operatively connected to the housing, the intermediate portion of the slider latch defines an anti-snag feature.

16. The modular plug according to claim 15, wherein the proximal end portion of the slider latch includes at least one dovetail projecting therefrom for selective engagement in a complementary channel formed in the housing.

17. The modular plug according to claim 15, wherein the proximal end portion of the slider latch includes finger grips.

18. The modular plug according to claim 15, wherein when the modular plug is connected to the plug receptacle, movement of the proximal end portion of the slider latch, relative to the housing, results in disengagement of the shoulders of the distal end portion of the slider latch from the shoulders of the plug receptacle.

* * * * *